United States Patent [19]

Ogawa

[11] Patent Number: 4,730,992

[45] Date of Patent: Mar. 15, 1988

[54] CONTINUOUSLY OPERABLE HYDRAULIC DEVICE

[75] Inventor: Kenji Ogawa, Musashino, Japan

[73] Assignee: Neuberg Company Limited, Tokyo, Japan

[21] Appl. No.: 30,205

[22] Filed: Mar. 24, 1987

[30] Foreign Application Priority Data

Mar. 26, 1986 [JP] Japan ..... 61-67696

[51] Int. Cl.[4] ..... F04B 19/00; F04B 19/22

[52] U.S. Cl. ..... 417/465; 417/488

[58] Field of Search ..... 417/465, 466, 487, 488

[56] References Cited

U.S. PATENT DOCUMENTS

| | | | |
|---|---|---|---|
| 1,143,325 | 6/1915 | Sherman | 417/488 |
| 2,447,467 | 8/1948 | Palm | 417/488 |
| 2,705,835 | 4/1955 | Massmann | 417/488 |
| 3,704,080 | 11/1972 | Cross | 417/488 |
| 4,405,294 | 9/1983 | Mcbarda | 417/488 |
| 4,492,524 | 1/1985 | Koch | 417/18 |

FOREIGN PATENT DOCUMENTS

| | | | |
|---|---|---|---|
| 776540 | 1/1935 | France | 417/488 |
| 285391 | 2/1928 | United Kingdom | 417/488 |

*Primary Examiner*—William L. Freeh

*Attorney, Agent, or Firm*—Flynn, Thiel, Boutell & Tanis

[57] ABSTRACT

This invention relates to a continuously operable hydraulic device usable as either a hydraulic pump or a hydraulic motor, including a plurality of unit hydraulic devices each having a pair of plungers. Operational association between these unit hydraulic devices makes it possible to discharge fluid at an accurate flow rate continuously or by a predetermined value, or to supply the fluid to rotate a driven component. Four pairs of plungers 51 and 56 are inserted into a port block 20 having a sucking port 25 and a discharge port 26 with the end faces thereof being opposed to each other. These plungers 51 and 56 are moved along a pair of cam surfaces 68A and 68B of a cam 68 by cam followers 69 and 70 which are connected to the plungers 51 and 56 via plunger driving shafts 73 and 75. These pairs of plungers 51, 56, the cam followers 69, 70 and the like constitute the unit hydraulic device 95. The unit hydraulic devices 95, in case of being as the hydraulic pump, are operated in operational association with the driving of the cam 68, and, in case of being as the hydraulic motor, are operated as the rotation of the cam 68 by the supplies of the fluid to spaces formed between the plungers 51 and 56.

5 Claims, 18 Drawing Figures

CONTINUOUSLY OPERABLE HYDRAULIC DEVICE

BACKGROUND OF THE INVENTION

1. Field of the Invention

This invention relates to a continuously operable hydraulic device utilizable in a continuous discharge pump, a hydraulically driven motor or the like.

2. Description of the Prior Art

As the continuously operable hydraulic device such for example as the continuous discharge pump, there have heretofore been developed ones of various types including (1) a screw pump in which a single thread screw is engaged between two double thread screws for rotation, (2) a vane type pump or a gear pump, (3) a duplex piston pump, (4) a three-throw plunger pump, and so forth. However, there are presented such problems that in the screw pump (1), although there is a linearity between the angle of rotation and the discharge flow rate, there occurs a leak because the seal is not a self-seal, whereby the screw pump is not suitable for delivering a very small quantity of fluid, in the vane pump and gear pump (2), the discharged fluid cannot avoid pulsations, in the duplex piston pump (3), when pistons are switched, there occurs a slight discontinuity, whereby the discharge flow rate cannot be held constant, and further, in the three-throw plunger pump (4), slight pulsations occur.

Now, the advanced technology requires the discharge pumps in which a discharge flow rate of a very small quantity can be controlled precisely. The applications thereof include (1) use in laboratories for the continuous operations on the very small quantities under high pressure, in the case of chromatograph, etc., (2) use in production factories for the purpose of continuously coating liquids such as chemical solutions, magnetic powder fluid dispersions onto articles continuously produced such as films, (3) use in chemical plants as pumps for continuously mixing at variable ratios, and (4) use in various factories for the computer control of liquids.

However, out of the above-described various conventional pumps, nothing has been developed to an extent where liquid of a very small quantity can be continuously discharged with high accuracy. Therefore, necessity has been voiced for a continuous discharge pump capable of discharging fluid of a very small quantity with a strict linearity in association with an angle of rotation of a driving source.

There are required not only the pumps capable of discharging fluid of a predetermined value under the operation of a driving source such as an electric motor as described above but also hydraulic driven motors for driving a driven component strictly through a predetermined angle by flowing fluid of a predetermined value. There has been needed a continuously operable hydraulic device capable of being applied to both pumps and motors.

SUMMARY OF THE INVENTION

An object of the present invention is to provide a continuously operable hydraulic device of a new type wherein, when a rotary driving source such as a motor is connected thereto, discharge of fluid strictly associated with an angle of rotation can be performed, while, when driving fluid of a predetermined value is caused to flow therethrough, an angle of rotation strictly associated with a flow rate can be obtained.

Another object of the present invention is to provide a continuously operable hydraulic device simplified in construction.

According to the present invention, a plurality of unit hydraulic devices each of which can drive a pair of plungers under a predetermined relationship, the pair of plungers are operationally associated with a rotating cam mechanism. When a rotary driving source such as a pulse motor is connected to this rotating cam mechanism, suction and discharge of fluid are performed by the pair of plungers, and a discharge value of the fluid is made to be constant as a whole by functions of the plurality of unit hydraulic devices so as to strictly associate an angle of rotation with a discharge value, thus providing a continuous discharge pump wherein the discharge value is associated with the angle of rotation of the rotary driving source. While, when driving fluid is fed between the pair of plungers, the rotating cam mechanism is rotatably driven, and such a hydraulic motor is provided wherein an angle of rotation of the rotating cam mechanism is strictly associated with a value of fed fluid, which is presumable from the case of the above-described continuous discharge pump.

More specifically, the present invention contemplates in a continuously operable hydraulic device, wherein a plurality of unit hydraulic devices are provided, each of the unit hydraulic devices comprises: a hollow port block; first and second ports communicated with the interior of this port block and provided at positions a predetermined distance spaced apart from each other; first and second plungers inserted into the port block in a manner to be axially slidable on one and the same axial line and the end faces of which are opposed to each other; and a rotating cam mechanism for driving the first and second plungers relative to the port block in a predetermined relationship with each other, said rotating cam mechanism having: an introducing function of moving the first and second plungers in direction for separating both plungers from each other by a predetermined value to introduce fluid of a predetermined value into a space formed between both plungers in a state where the space formed between the end faces of the first and second plungers, which are opposed to each other is communicated with the first port; a valve switching function for effecting a moving of the first and second plungers relative to the port block to positions where a portion of the liquid introduced in the space formed between the first and second plungers is communicated with the second port in such a manner that the first and second plungers are held in the above-described positional relationship; and a discharging function effecting a movement of first and second plungers toward each other by a predetermined value after both plungers are moved toward the second port, to thereby discharge the fluid introduced into the space formed between the first and second plungers. Timings of actions of these unit hydraulic devices are set such that the total quantity of the fluid caused to be discharged from the unit hydraulic devices by the rotating cam mechanism becomes constant at all times.

Furthermore, according to the present invention, cam followers being in contact with cam surfaces of the rotating cam mechanism are connected by a wire in an endless manner so that the cam followers are urged against the cam surfaces, respectively.

More specifically, the present invention features a continuously operable hydraulic device wherein the rotating cam mechanism includes: a cam having first and second cam surfaces; first cam followers being in contact with the first cam surfaces and connected to the first plungers; and second cam followers being in contact with the second cam surfaces and connected to the second plungers; and wire stretched in an endless manner so that the cam followers can be urged in directions of being abutted against the cam surfaces.

DETAILED DESCRIPTION OF THE PREFERRED EMBODIMENTS

Description will hereunder be given of the first embodiment in which the present invention is applied as a continuous discharge pump with reference to FIGS. 1 to 9.

Figure 1:
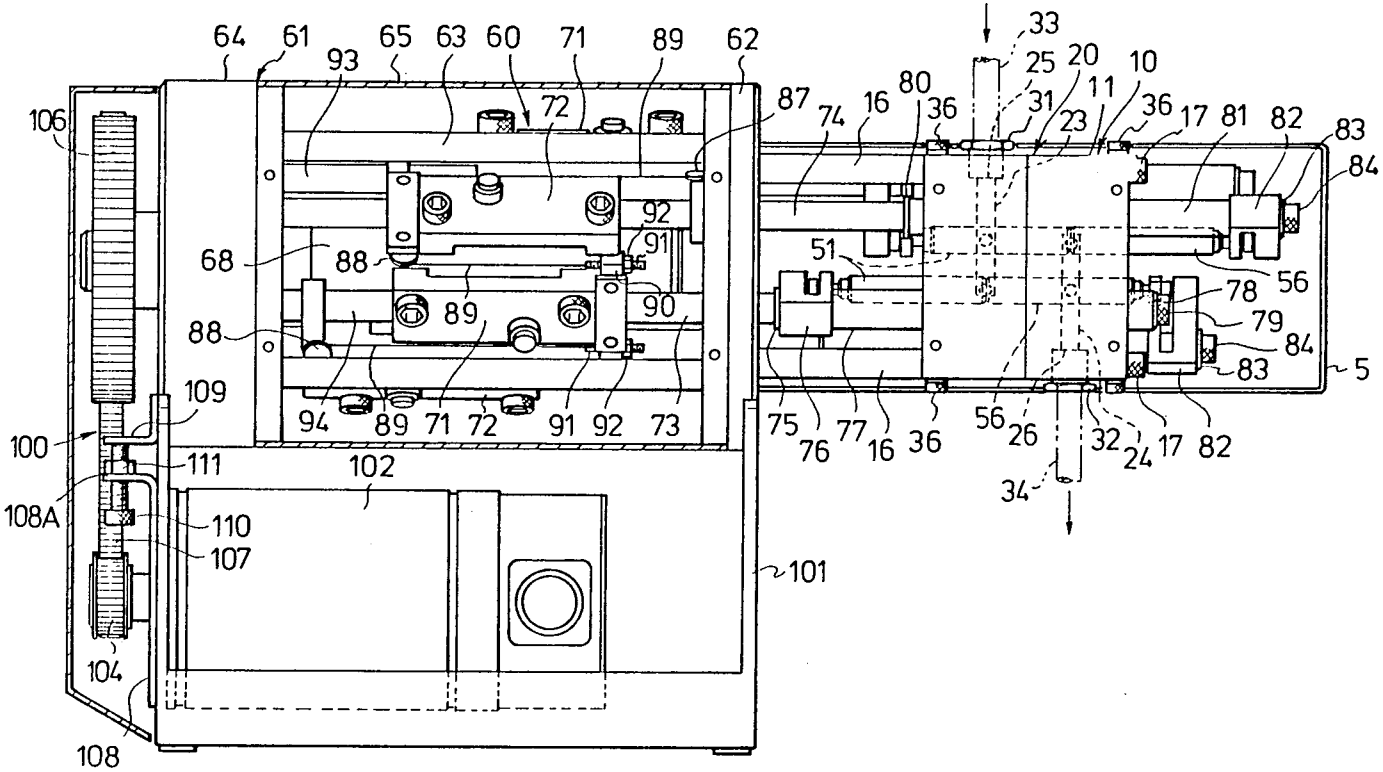
FIG. 1 is a partially sectioned front view generally showing the arrangement of a first embodiment of the present invention.

In the general arrangement view in FIG. 1, the device of this embodiment is divided into three mechanisms including a hydraulically participating mechanism 10 shown as being projected to the right in the drawing, a rotating cam mechanism 60 for driving this hydraulically participating mechanism 10 in a predetermined relationship as shown above in the center of the drawing, and a rotatable driving mechanism 100 for rotatably driving this rotating cam mechanism 60 as shown from the left end to the bottom in the center of the drawing.

Figure 2:
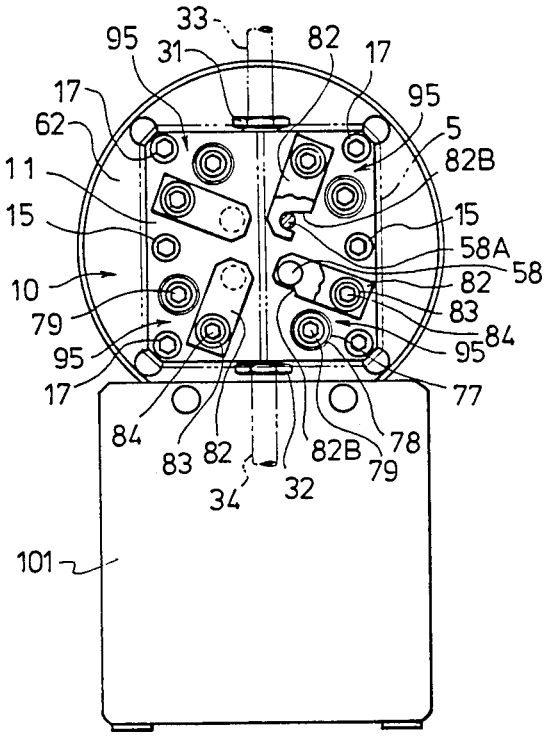
FIG. 2 is a side view of FIG. 1.
Figure 3:
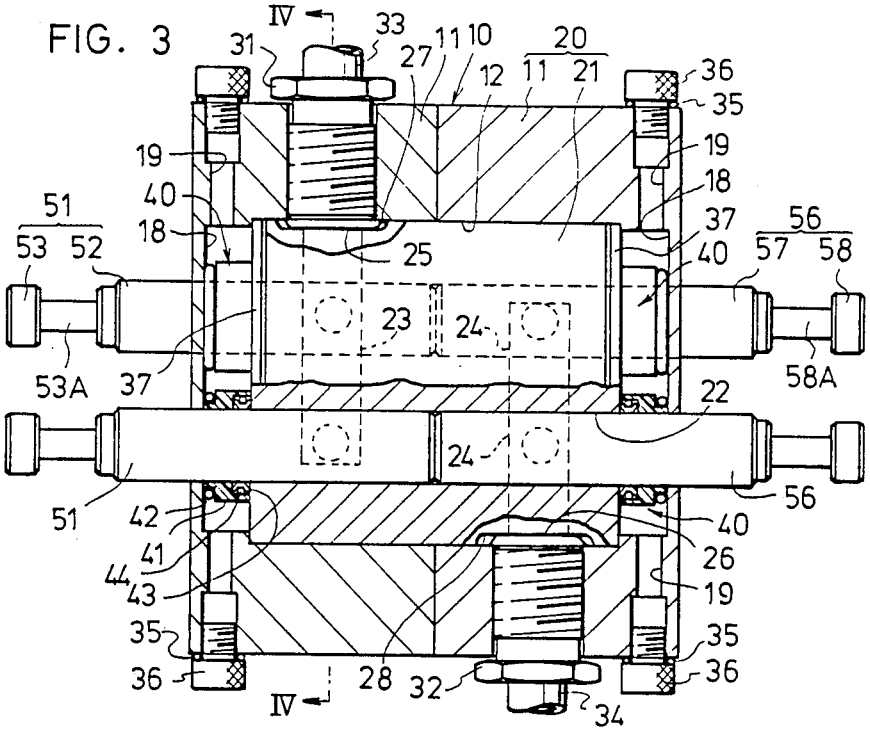
FIG. 3 is an enlarged sectional view taken along about the line III—III in FIG. 4, showing a hydraulically participating mechanism.
Figure 4:
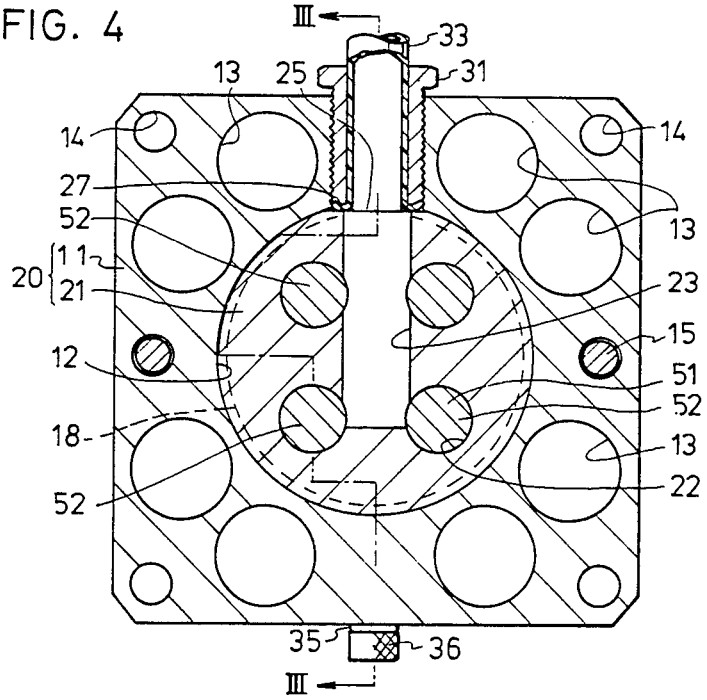
FIG. 4 is a sectional view taken along the line IV—IV in FIG. 3.

The hydraulically participating mechanism 10 has an outer block 11 divided into right and left sections. As shown in FIGS. 3 and 4, this outer block 11 is formed to provide a generally parallelepiped form, and provided on the inner periphery thereof with an inner block receiving hole 12. Further, every two plunger driving shaft insertion holes 13 on every corner of this receiving hole 12, i.e. totally eight plunger driving shaft insertion holes 13 are provided, and each one outer block mounting bolt insertion hole 14 between every two shaft insertion holes 13 on every corner, i.e. totally four outer block mounting bolt insertion holes 14 are provided. Furthermore, the two sections formed by dividing the outer block 11 are integrally fixed to each other by two bolts 15 (Refer to FIG. 2). As shown in FIGS. 1 and 2, four corners of the outer block 11 thus integrally fixed are secured to a front plate 62 as being one of end plates of a frame 61 of the rotating cam mechanism 60 by mounting stays 16 and bolts 17.

A cylindrical inner block 21 made of ceramics ($Al_2O_3$) is received in the inner block receiving hole 12 formed in the outer block 11. These outer and inner blocks 11 and 21 constitute a port block 20. Four hollow plunger insertion holes 22 are formed in the inner block 21 in the axial direction thereof. Communication holes 23 and 24, with which the insertion holes 22 are communicated are penetrated in opposed relationship to each other from the peripheral surface of the block 21 to the halfway of the interior thereof at positions near the opposite end portions of these four plunger insertion holes 22, i.e. positions a predetermined distance spaced apart from each other in the axial direction thereof. Openings of these communication holes 23 and 24 on the peripheral surface of the block are formed to provide a first port 25 and a second port 26, i.e. a sucking port and a discharge port. Furthermore, cutaway portions 27 and 28 are formed around these first and second ports 25 and 26, respectively. Threadably coupled into the outer block 11 at positions opposed to these cutaway portions 27 and 28 are tube set screws 31 and 32. These set screws 31 and 32 are made hollow and first and second tubes 33 and 34 are inserted through center holes of the set screw 31 and 32, respectively. The forward ends of these tubes 33 and 34 are turned back. These turned back ends are clamped between the set screws 31, 32 and the cutaway portions 27, 28, so that the tubes 33 and 34 can be fixed to the outer and inner blocks 11 and 21, i.e. the port block 20.

Recesses 18 for the drain are connectedly provided on opposite ends of the inner block receiving hole 12 of the outer block 11. Every two drain holes 19 are formed in the recesses 18 at the opposite ends, and these drain holes 19 are sealed by seal screws 36 through O-rings 35, respectively. These seal screws 36 are untightened to thereby discharge fluid accumulated in the recess 18.

O-rings 37 are interposed between the corner portions at the opposite end faces of the inner block 21 and the corner portions of the inner block receiving hole 12 of the outer block 11 to thereby achieve the sealing. Furthermore, seal units 40 are respectively interposed at positions opposed to the plunger insertion holes 22 between the opposite end faces of the inner block 21 and the inner end faces of the recesses 18 for the drain of the outer block 11, so that sealing with a pair of first and second plungers 51 and 56 which are inserted into plunger insertion holes 22 of the inner block 21 and sealing with the inner end faces of the recesses 18 for the drain of the outer block 11 can be achieved.

Figure 5:
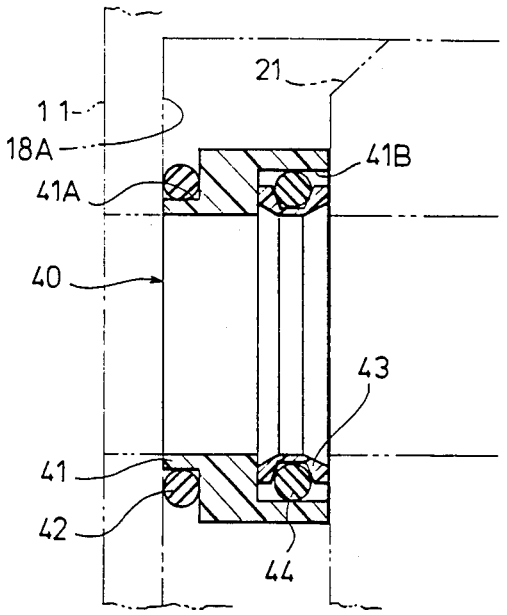
FIG. 5 is an enlarged sectional view showing a seal unit used in the above embodiment.

As enlargedly shown in FIG. 5, the seal unit 40 is constituted by: a holder 41 made of a synthetic resin material such as polyacetal; an externally fitted O-ring 42 engaged with an outer stepped portion 41A formed on the holder 41 on the side of abutting against the outer block; a slipper seal 43 made of a synthetic resin material such as polytetrafluoroethylen (Brand name Teflen), provided in an inner stepped portion 41B formed on the inner periphery of the holder 41 on the side of abutting against the inner block, and being in sliding contact with the outer peripheral surfaces of the plungers 51 and 56; and an internally fitted O-ring 44 for the back-up of the slipper seal 43 provided between this slipper seal 43 and the inner stepped portion 41B of the holder 41.

As shown in FIG. 3, the first and second plungers 51 and 56 are constituted by plunger bodies 52 and 57 made of ceramics to be inserted into the plunger insertion holes 22 and metallic heads 53 and 58 fixed to the outer ends of these plunger bodies 52 and 57. Portions of these heads 53 and 58 connected to the plunger bodies 52 and 57 are formed to provide small diameter neck portions 53A and 58A.

Figure 6:
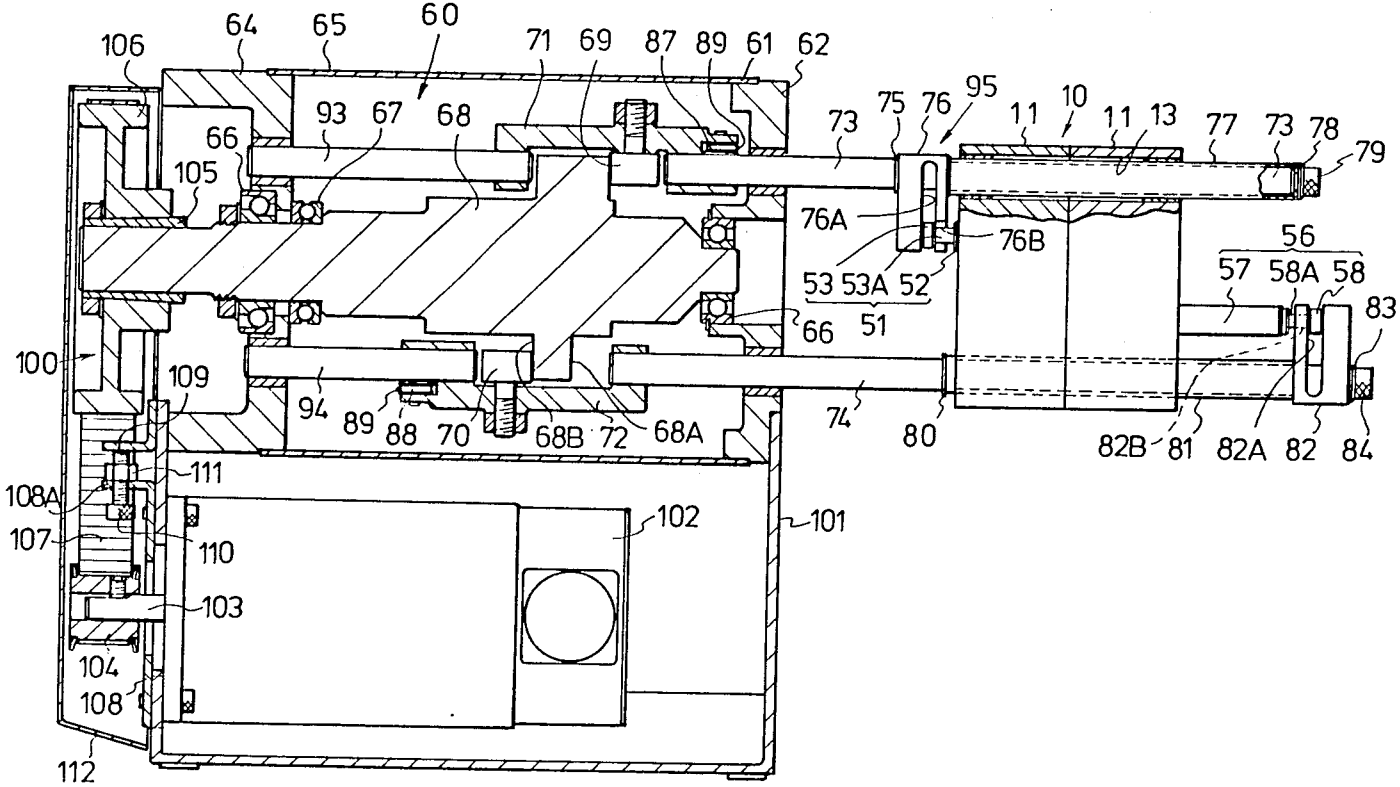
FIG. 6 is an enlarged sectional view partially emittingly showing FIG. 1.

As shown in FIG. 6, the rotating cam mechanism 60 is connected to the front plate 62 through connecting bars 63 (Refer to FIG. 1) and has a rear plate 64 which constitutes the frame 61 in cooperation with the front plate 62. A space formed between this rear plate 64 and the front plate 62 is covered by a cover 65. Furthermore, the rotating cam mechanism 60 has a cam 68 rotatably supported on the front plate 62 and the rear plate 64 through two radial bearings 66 and a thrust bearing 67. Every four first and second cam followers 69 and 70 formed of rollers, respectively, are alternately abutted against a pair of cylindrical end face-shaped first and second cam surfaces 68A and 68B. Each of these cam followers 69 and 70 is rotatably supported by brackets 71 and 72 being of U-shape in the side surface. Each of the four brackets 71 and 72 is divided into sets of the brackets 71 and 72, whereby four sets of the brackets 71 and 72 are provided. Each set is arranged equidistantly, i.e. at intervals of 90° around the peripheral surfaces of the cylindrical end face-shaped first and second cam surfaces 68A and 68B. The cam followers 69 and 70 secured to every sets of brackets 71 and 72 are made to make an angle of 30° with the axis of the cam 68, respectively, in a manner not to interfere with each other.

Figure 7:
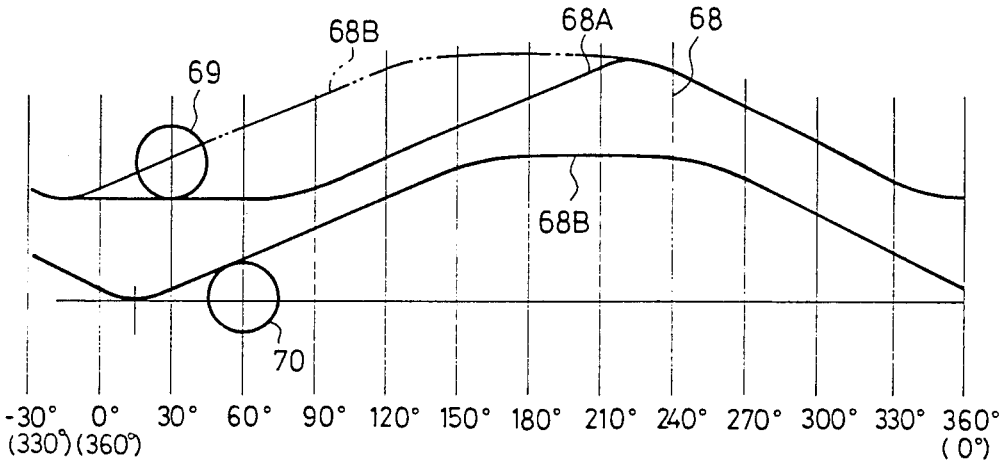
FIG. 7 is a cam diagram used in the above embodiment.

FIG. 7 is a cam diagram showing the contours of the pair of the first and second cam surfaces 68A and 68B of the cam 68. The cam surface 68B has the same form as the cam surface 68A and is symmetric with respect to an axis with the cam surface 68A, being rotated through 180° from the latter, the second cam surface 68B being located at a position circumferentially more advanced through 30° than the first cam surface 68A, and this lead angle 30° is associated with the angular relationship between the cam followers 69 and 70. As a consequence, the second cam surface 68B indicated by a chain line in FIG. 7 is one in which the second cam surface 68B is moved in a direction of lagging through 30° and further moved to a position as high as the first cam surface 68A to overlap with it. A generally parallelogrammatic portion defined by these cam surfaces 68A and 68B is a difference between the movements of the cam followers 69 and 70, and, due to this difference, operations of suction and discharge of the liquid, i.e. the pumping action is performed.

The sets of the first and second cam followers 69 and 70 are operationally associated with the pairs of plungers 51 and 56 inserted into the four plunger insertion holes 22 of the inner block 21 in the hydraulically participating mechanism 10, respectively. More specifically, a first plunger driving shaft 73 is fixed to an end portion of one 71 of the brackets on the side of the front plate 62 and a second plunger driving shaft 74 is fixed to an end portion of the other 72 of the brackets on the side of the front plate 62, respectively. These shafts 73 and 74 are extended to the outside through the totally eight plunger driving shaft insertion holes 13 formed in the outer block 11 of the hydraulically participating mechanism 10.

The proximal portion of a clamp 76 engaged at one end face with a stop ring 75 is inserted through the intermediate portion of the first shaft 73, one end of a pipe 77 coupled onto the shaft 73 is abutted against the other end face of this clamp 76, the other end of this pipe 77 is protruded slightly farther than the shaft 73, a washer 78 is abutted against the protruded end of this pipe 77, and a bolt 79 is extended through this washer 78 and threadably coupled to the forward end of the shaft 73, whereby the clamp 76 is urged against the stop ring 75 via a pipe 77. Except a part of the proximal portion of the clamp 76, through which the shaft 73 is extended, this clamp 76 is formed with a slit groove 76A. A generally U-shaped cutaway groove 76B is formed on one side divided by this slit groove 76A, and this cutaway groove 76B is engaged with the small diameter neck portion 53A of the head 53 of the first plunger 51. In this case, the groove width of the slit groove 76A of the clamp 76 is made slightly larger than the top thickness of the head 53 of the plunger 51. When no force is applied to the clamp 76, the cutaway groove 76B of the clamp 76 is made engageable with and disengageable from the neck portion 53A of the head 53. Whereas, when the proximal portion of the clamp 76 is urged through the pipe 77 due to the threadable coupling of the bolt 79 with the shaft 73, the clamp 76 is deformed such that the slit groove 76A is narrowed down, so that the head 53 of the plunger 51 can be fixed with no looseness. As a consequence, when the shaft 73 is moved axially, the first plunger 51 is axially moved therewith via the clamp 76.

Similarly to the first plunger driving shaft 73, the second plunger driving shaft 74 is connected thereto with the second plunger 56. In this case, the second plunger 56 is protruded in a direction opposite to the first plunger 51 with respect to the outer block 11, whereby the arrangement of members secured to the second shaft 74, for the connection is different from the arrangement in the case of the first shaft 73. More specifically, a stop ring 80 is secured to the intermediate portion of the second shaft 74 and a pipe 81 is coupled onto the shaft 74 so as to be abutted against this stop ring 80. This pipe 81 has a length not reaching the forward end of the shaft 74, and the proximal portion of a clamp 82 having the same construction as the clamp 76 is inserted therethrough with the forward end portion of the shaft 74 protruded from this pipe 81. The outer end face of this clamp 82 is slightly protruded from the forward end of the shaft 74, and the clamp 82 is fixed to the shaft 74 by a bolt 84 extending through this clamp 82 and a washer 83, and threadably coupled to the forward end of the shaft 74. This clamp 82 also has a slit groove 82A and a cutaway groove 82B, and this cutaway groove 82B is engaged with and fixed to the neck portion 58A of the head 58 of the second plunger 56, so that the movement of the second shaft 74 can be transmitted to the second plunger 56 as it is.

Pulleys 87 and 88 are rotatably supported on each of the four, total of eight brackets 71 and 72 except one (one of the brackets 71 in this embodiment) at two positions of the respective corner portions on the same side as the first and second cam followers 69 and 70 are provided as opposed to the first and second cam surfaces 68A and 68B, and a wire 89 is guided around these pulleys 87 and 88 under satisfactory tensile force in a zigzag manner so that the cam followers 69 and 70 of the brackets 71 and 72 can be urged in directions of abutting against the cam surfaces 68A and 68B. Opposite end portions of this wire 89 are fixed only to the bracket 71 not provided with the pulleys 87 and 88, whereby the wire 89 is guided around the brackets 71 and 72 in an endless manner, so that the cam followers 69 and 70 can be constantly abutted against the cam surfaces 68A and 68B. In this case, as in FIG. 1, fixing of the opposite end portions of the wire 89 to the bracket 71 is carried out by fixing the end portions of the wire 89 to ends of adjusting screws 91 positionally adjustably, threadably coupled into an arm 90 having opposite end portions protruding from opposite side surfaces of the bracket 71 at the same positions as the pulleys 87 and 88 are provided in other brackets 71 and 72. Tension of the wire 89 can be set at a suitable value by rotating these adjusting screws 91. Furthermore, a lock nut 92 is threadably coupled onto the other end of each of these adjusting screws 91, whereby the adjusting screw 91 is locked. In this case, the states of guiding the wire 89 around the pulleys 87 and 88 of the brackets 71 and 72 may be referred to FIG. 8 to be described hereunder., however, in this FIG. 8, for preventing the drawing from being complicated and for easier understanding, the two pulleys 87 and 88 are reduced in number to one, and one 72 of the brackets, which should be positioned on the side opposite to the other 71 of the brackets with respect to the cam 68 is positioned on the same side as the other bracket 71 is located, and further, illustration of the various section are simplified in construction.

Additionally, support rods 93 and 94 are connected to the rear plate 64 of the brackets 71 and 72 on the side of the rear plate 64, and are slidably supported by the rear plate 64, respectively, whereby the brackets 71 and 72 are supported at the opposite ends.

Here, a unit pump 95 as being a unit hydraulic device is constituted by: the outer block 11, into which the pairs of the first and second plungers 51 and 56 are inserted; the respective portions of the inner block 21 and parts such as the seal unit 40 to be coupled to these portions; the first and second plunger driving shafts 73 and 74 connected to the pairs of first and second plungers 51 and 56 through the clamp 76 and 82; the first and second cam followers 69 and 70 for driving these shafts 73 and 74 along the first and second cam surfaces 68A and 68B of the cam 68; and the brackets 71 and 72. As a consequence, the continuously operable hydraulic device in this embodiment is constituted by four unit pumps 95.

The rotatable driving mechanism 100 has a motor 102 as being a rotatably driving source positionally adjustably mounted to a base plate 101 supporting the front and rear plates 62 and 64. This motor 102 is a rotatably controllable motor such as a stepping motor, a pulse motor or a servo motor. A timing belt 107 is guided around a timing pulley 104 fixed to an output shaft 103 of this motor 102 and a timing pulley 106 fixed to the end portion of the cam 68, which is protruded from the rear plate 64 through a tapered bush 105, whereby the cam 68 is rotated through a predetermined angle by the driving of the motor 102. The rotatably driving mechanism 100 has a slide plate 108 for positionally adjustably mounting the motor 102 to the base plate 101, and has an adjusting bolt 110 positionally adjustably, threadably coupled to a turned-back portion 108A at the top end of this slide plate 108 and abutted at the forward end thereof against a stopper 109 of the base plate 101, and a lock nut 111 for locking this adjusting bolt 110. This slide plate 108 is positionally adjusted to thereby avoid the looseness of the timing belt 107. Further, an end cover 112 is provided to the left of the rear plate 64 in a manner to cover the timing pulleys 104, 106 and the like.

In FIGS. 1 and 2, designated at 5 is a cover to cover the hydraulically participating mechanism 10 and thereabout.

Figure 8:
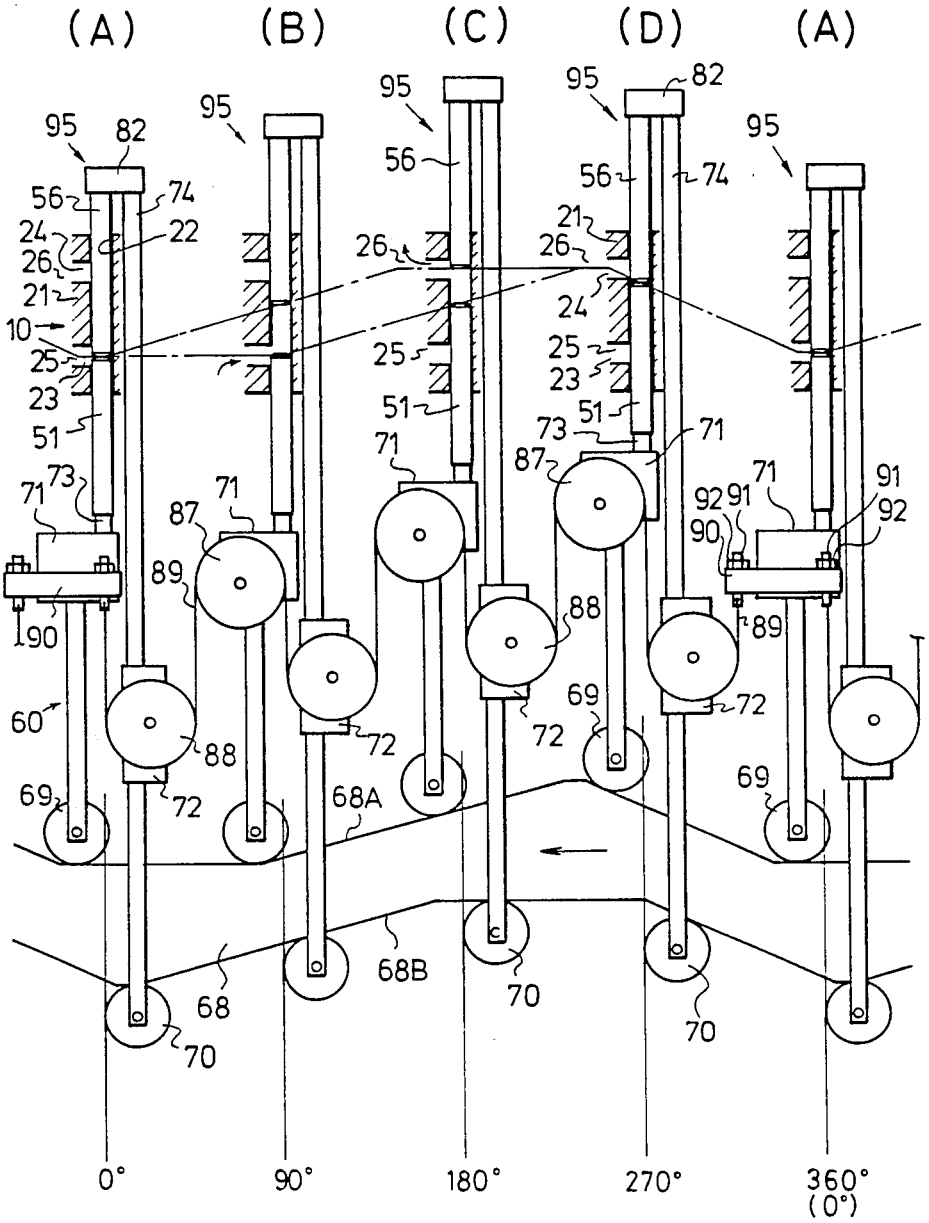
FIG. 8A to 8D are views illustrating the above embodiment in an actuated position.
Figure 9:
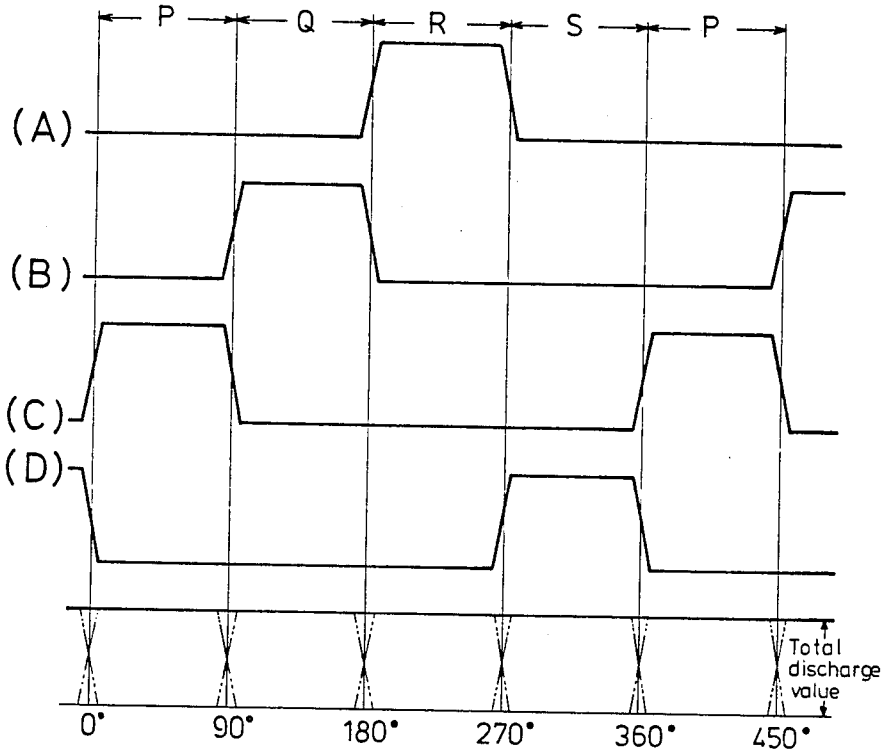
FIG. 9 is an explanatory view showing the state of discharge in the above embodiment.

Description will hereunder be given of action of this embodiment with reference to FIGS. 8 and 9 as well.

In FIGS. 1 and 6, rotation of the motor 102 rotatably drives the cam 68 through the timing pulley 104, timing belt 107 and timing pulley 106. Along with rotation of this cam 68, the first and second cam followers 69 and 70 move while following the contours of the first and second cam surfaces 68A and 68B, to thereby move the first and second plunger driving shafts 73 and 74 to the right and left through the brackets 71 and 72. Driving of the brackets 71 and 72 causes the first and second plungers 51 and 56 of each of the unit pumps 95 to be driven along the contours of the cam surfaces 68A and 68B in predetermined relationships.

FIG. 8 shows the relationships between the first and second cam surfaces 68A and 68B of the cam 68 and the first and second plungers 51 and 56 of each of the unit pumps 95. Here, in FIG. 8, the drawing is simplified as described above, however, the action is completely the same, so that the action will be described with reference to this drawing. In this FIG. 8, denoted at (A)–(D) are four states of the unit pumps 95, and a timings of the actions of these unit pumps 95 are shown in FIG. 8. Referring to the drawing, in the leftmost, i.e. the unit pump 95 in the state (A), the first and second plungers 51 and 56 are at positions closest to each other with a slight space formed between the end faces thereof, and the space formed between the closely approached end face is in a state being communicated with the first ports 25. This state is a state immediately before sucking liquid (fluid) of a predetermined value from a liquid (fluid) tank, not shown, which is connected to the first port 25. As a consequence, the first port 25 functions as a sucking port. Additionally, the reason why, in this state (A), the first and second plungers 51 and 56 are at positions closest to each other and still the end faces thereof are not directly abutted against each other resides in that the movements of the both plungers 51 and 56 are caused to follow the contours of the cam surfaces 68A and 68B as they are. If the both plungers 51 and 56 are directly abutted against each other, then, due to this abutment, the positions of the both plungers 51 and 56 are determined, so that the plungers 51 and 56 can not perform the movements accurately following the contours of the cam surfaces 68A and 68B.

Next, the unit pump 95 in the state (B) is provided at a position rotated from the unit pump 95 in the state (A) through 90°, and consequently, there is shown the same state as one in which the cam 68 is rotated in a direction indicated by an arrow mark in the drawing through 90° with respect to the unit pump 95 of (A). In this unit pump 95 of (B), since the first cam surface 68A is in the flat state, the first plunger 51 holds the position as high as the state (A). Whereas, since the second cam surface 68B becomes a cam surface in the direction of rising, the second plunger 56 moves in a direction of being separated from the first plunger 51, whereby a predetermined space is formed between the end faces of the first and second plungers 51 and 56, and liquid of a predetermined value is sucked in (introduced) from the first port 25. This function of (B) is the sucking (introducing) function. Furthermore, a volume of a space formed during the process of (B) corresponds to a sucked value of the liquid.

Subsequently, when the state (C) is brought about, the cam 68 is brought into a state where the cam 68 is further rotated through 90° and the first plunger 51 begins to rise along the first cam surface 68A which has become an upwardly directed, inclined surface, while, the second plunger 56 has completed rising and is in a stopped state through the action of the second cam surface 68B which has turned from an inclined surface into a horizontal surface. Since the end face of the second plunger 56 is communicated with the second port 26 in this stopped state, as the first plunger 51 rises, the liquid of the predetermined value, which has been sucked by the first and second plungers 51 and 56 is discharged to the outside through the second port 26. As a consequence, the second port 26 functions as the discharge port. Additionally, in the intermediate stage where the process is transferred from (B) to (C), there is such a state that both the cam surfaces 68A and 68B are upwardly directed, inclined surfaces in parallel to each other, during which state, the first and second plungers 51 and 56 are moved in parallel to each other with the distance between the both end faces being held constant, whereby the liquid held in the space formed between both end faces of the plungers 51 and 56 is transferred from the first port 25 to the second part 26. This switching from (B) to (C) is made to be a valve switching operation, and the state (C), i.e. the state where the first plunger 51 approaches the second plunger 56 is made to be the discharging operation. Furthermore, the moving path of the end face portions of the first and second plungers 51 and 56 is indicated by one-dot chain line in the drawing, and this moving path coincides with the generally parallelogrammatic shape described in FIG. 7.

Subsequently, when the state (D) is brought about, there is shown that the first plunger 51 completes rising and the state, where the end faces of the first and second plungers 51 and 56 are brought into positions closest to each other, is realized immediately before the state (D). Further, the first plunger 51 enters the lowering process, and the second plunger 56, which has stopped at the top end, enters the lowering process. Lowering of these first and second plungers 51 and 56 are performed while both end faces are in the positions closest to each other. This state (D) is a state where the cam 68 is further rotated from the state (C) through 90°, and, when the cam 68 is further rotated from this state (D), the state (A) is restarted again. The movement from the state (D) to the state (A) is performed with the end faces of the first and second plungers 51 and 56 being held at the positions closest to each other, and switching from (D) to (A) is a valve switching process (return).

As the cam 68 rotates in the direction indicated by the arrow mark in FIG. 8 as described above, the respective unit pumps 95 repeats cycles of passing through the states (A)-(D) and returning to the state (A) again, thus repeating the operations of sucking the liquid of the predetermined value from a tank of the liquid of the predetermined type which is connected to the first port 25 and discharging the same from the second port 26. During this discharge, as shown in FIG. 8, the four unit pumps 95 are brought into the state deviated in phase of 90° from one to another, and the unit pumps 95 alternately, continuously perform discharging.

FIG. 9 shows the states of discharging corresponding to the angles of rotation of the cam 68 of the unit pumps 95 as explained in FIG. 8. The states (A)-(D) in this drawing correspond to the unit pumps 95 in FIG. 8, respectively. If attention is paid to the unit pump 95 of (A), then a section P from 0° to 90° is a sucking process, a section Q from 90° to 180° is a valve switching process, a section R from 180° to 270° is a discharging process, and further, a section S from 270° to 360° is a returning valve switching process. Furthermore, the unit pumps 95 are deviated in discharging process through 90° from one to another. Change in flow rate between the start and the end of discharge is determined such that any one of the unit pumps 95 and another unit pump 95 deviated through 90° from the former pump are in the reverse relationship with each other in the increase and decrease of the flow rates, and consequently, even in the states of change in flow rates, the combined discharge rate of the pumps adjoining each other becomes constant. As a consequence, the combined discharge value of the four unit pumps 95, i.e. the total discharge value is constant at all times as shown at the bottom of FIG. 9.

Additionally, description has been given of the action, in which the cam 68 is rotated in the direction indicated by the arrow mark in FIG. 8, whereby the first and second plungers 51 and 56 are successively transferred from the state (A) to the state (D). However, since the first and second cam surfaces 68A and 68B are formed symmetrically with each other, if the cam 68 is rotated in the direction reverse to the above, the first and second plungers 51 and 56 of the respective unit pumps 95 are transferred from the state of (D), passed through the states (C) and (B), and transferred to the state (A), and, contrary to the above, the second port 26 becomes the sucking port and the first port 25 becomes the discharge port, to thereby perform suction and discharge of the fluid. As a consequence, in this embodiment, for the convenience of explanation, the first port, the second port, the sucking port and the discharge port are nominated as above, so that the substances of these ports are changed depending on the modes of use.

Furthermore, the inner block 21, the plungers 51 and 56, which are formed of ceramics, are subjected to selective coupling, where the sizes are checked for coupling, whereby leakage of fluid between the plungers 51, 56 and the plunger insertion holes 22 can be made very small by use of the finishing techniques at present, however, leakage cannot be eliminated and a very small leak occurs. This leak passes through spaces formed between the seal unit 40 and the end face of the inner block 21 and enters the recess 18 for the drain and is accumulated therein. In this case, a space formed between the seal unit 40 and the plungers 51 and 56 is satisfactorily sealed by the slipper seal 43 and the internally fitted O-ring 44, and a space formed between the seal unit 40 and the inner end face of the outer block 11 is satisfactorily sealed by the externally fitted O-ring 42, whereby no fluid flows to the outside. On the other hand, the fluid accumulated in the recess 18 for the drain can be discharged by untightening the seal screw 36.

With the above-described embodiment, the following advantages can be obtained.

More specifically, in this embodiment, the pair of plungers 51 and 56 which are rectilinearly movable in the predetermined relationship are used to perform the sucking and discharging, whereby there is almost no need of worrying about the leakage of the fluid in the portions of the plungers 51 and 56, so that accuracy in the discharge flow rate can be held. In this case, since a very small leak from around the peripheral surfaces of the plungers 51 and 56 is made to be accumulated in the recesses 18 for the drain, the leak of fluid does not come into contact with the synthetic resin material, rubber or the like of the seal unit 40, or the fluid, which may stagnate for a long period of time after leaking and degenerate, does not return to the sides of the first and second ports 25 and 26, so that impurities can be satisfactorily prevented from being mixed with the discharged fluid. Since the plungers 51 and 56 are driven by the rotating cam mechanism 60 having the cam 68, the mechanisms are simplified in construction and the device can be made compact in size in manufacture. Further, since the end faces of the plungers 51 and 56 are not directly abutted against each other, the plungers 51 and 56 are connected to the cam followers 69 and 70 with no looseness via the clamps 76 and 82, and the cam followers 69 and 70 are made to be abutted against the cam surfaces 68A and 68B by the single wire 89, the abutting forces of the cam followers 69 and 70 against the cam surfaces 68A and 68B can be made equal to each other. Since the cam followers 69 and 70 move along the contours of the cam surfaces 68A and 68B which have been precisely finished, the movements of the pairs of cam followers 69 and 70 per turn of the cam 68, i.e. the movements of the plungers 51 and 56 of the respective unit pumps 95 per turn of the cam 68 become equal to each other, so that the discharge values of the respective unit pumps 95 can be made equal to one another. Furthermore, since the plurality of unit pumps 95 are used and the unit pumps 95 are driven in the predetermined relationship, the total discharge value of the hydraulically participating mechanism 10 as a whole can be constant at all times by making the unit pumps 95 compensate one another in discharge value, so that a discharge pump having no pulsations at all can be provided. Further, since the total discharge value of the hydraulically participating mechanism 10 is accurately proportional to rotation of the motor 102, the angles of rotation of the motor 102 are controlled, whereby, regardless of the state and position of the hydraulically participating mechanism 10, a very small value of the fluid such for example as about 0.1 μl per pulse can be discharged at a highly accurate flow rate at all times, so that the discharge value having high linearity to the angle of rotation of the rotating cam mechanism 60 can be secured. Further, since connection between the rotating cam mechanism 60 and the hydraulically participating mechanism 10 is made such that the slit grooves 76A and 82A of the clamps 76 and 82 are engaged with the heads 53 and 58 and are merely tightened with the bolts 79 and 84 by the utilization of resiliencies obtained through the functions of the slit grooves 76A and 82A, when the bolts 79 and 84 are untightened, the clamps 76 and 82 can be easily disengaged from the heads 63 and 58 of the plungers 51 and 56. Further, in this state, if the outer block 11 is removed from the front plate 62, then a portion of the port block 20 as being a liquid contact portion can be easily removed, so that the work of cleaning the port block 20 and the like can be performed for a very short period of time. Since the inner block 21 and the plungers 51 and 56, which are liquid contact portions, are all made of ceramics, the above-mentioned members are applicable to all of the fluids, regardless of the qualities of fluids.

Figure 10:
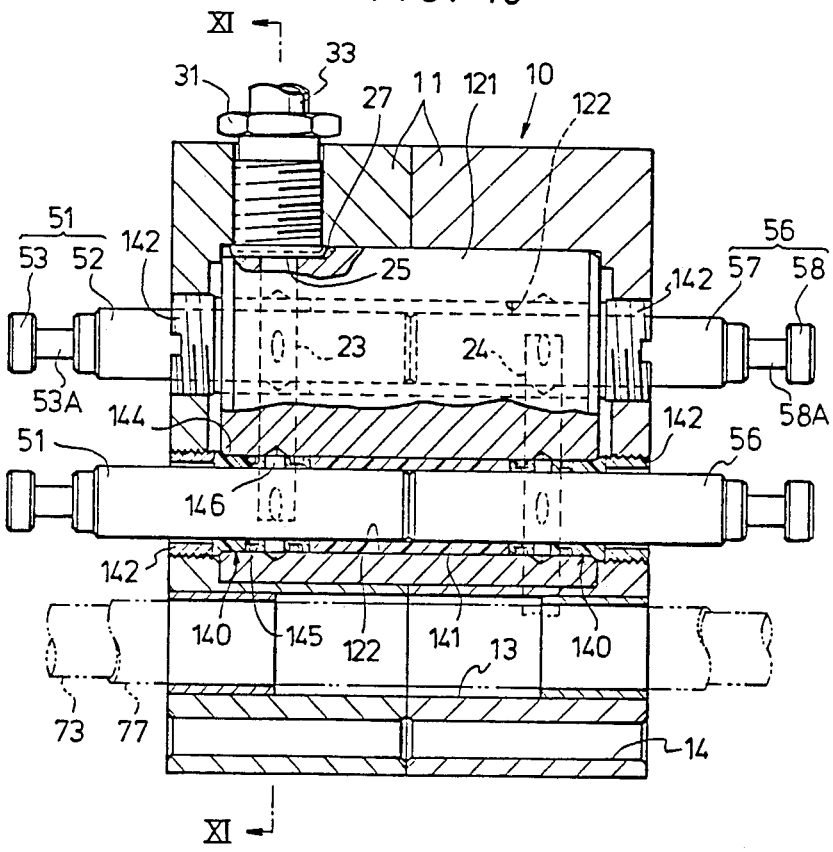
FIG. 10 is a sectional view taken along about the line X—X in FIG. 11 showing a hydraulically participating mechanism in a second embodiment of the present invention.
Figure 11:
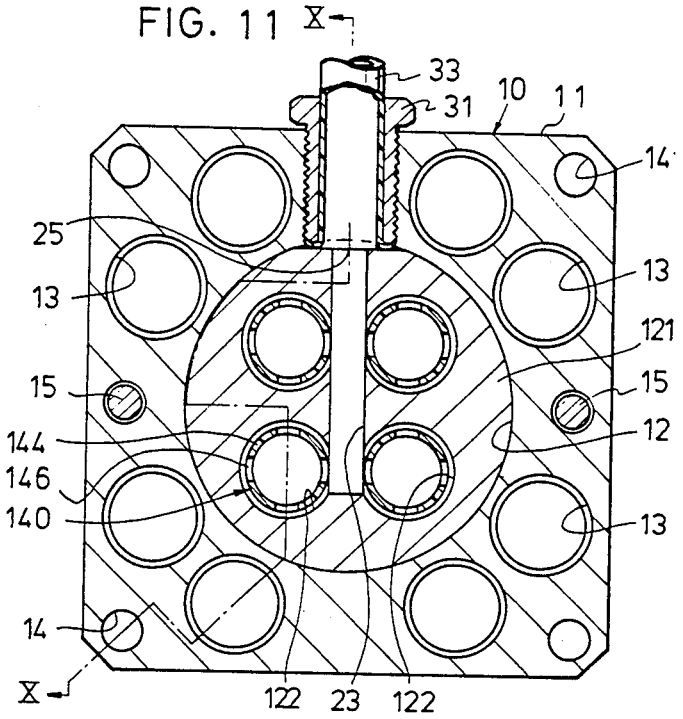
FIG. 11 is a sectional view taken along the line XI—XI in FIG. 10.

Additionally, in the first embodiment, the inner block 21 has been made of ceramics, however, the present invention need not necessarily be limited to this, and an inner block 121 made of a synthetic resin material such as polytrifluoroethylene (Brand name: Diflon (phonetic)) may be used as in the second embodiment shown in FIGS. 10 to 12. More specifically, in FIGS. 10 and 11, the material quality of the inner block 121 and the seal construction based on this difference in the material quality are the respects in the arrangement greatly differed from the first embodiment, and other respects are similar in construction to the first embodiment, and hence, same reference numerals as shown in the first embodiment are used to designate same or similar component parts, so that description will be omitted or simplified. In FIGS. 10 and 11, similarly to the first embodiment, the first and second plungers 51 and 56 are constituted by plunger bodies 52 and 57 made of ceramics and metallic heads 53 and 58. While, plunger insertion holes 122 of the inner block 121 are made larger in diameter than these in the first embodiment. Seal units 140 are inserted from the end faces of the inner block 121 into communication portions where communication holes 23 and 24 of these insertion holes 122 are communicated with the first and second ports 25 and 26. A spacer 141 made of a synthetic resin material such as polyacetal is interposed between these seal units 140. These two seal units 140 and the spacer 141 are locked against dislodging by a hollow set screw 142 threadably coupled into the outer block 11. As enlargedly shown in FIG. 12, the seal unit 140 is constituted by a seal pipe 144 made of tetrafluoroethylene and two O-rings 145 held on the outer periphery of this seal pipe 144 and spaced a predetermined distance apart from each other. A plurality of holes 146 for communicating the communication hole 23 or 24 with the interior of the seal pipe 144 are formed in the seal pipe 144 at intermediate positions between the two O-rings 145. The portions, where the O-rings 145 are provided, are formed to provide thin wall portions 147, and the inner surfaces of the thin wall portions 147 are closely attached to the plunger 51 or 56 by the elasticity of the O-rings 145, so that satisfactory sealing can be achieved.

Figure 12:
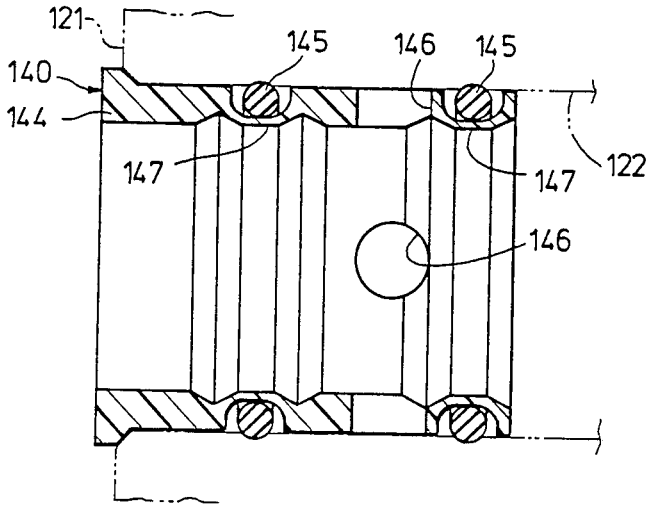
FIG. 12 is an enlarged sectional view showing a seal unit used in the second embodiment.

With the second embodiment of the present invention shown in FIGS. 10 to 12 as described above, the effects substantially similar to the first embodiment can be advantageously achieved and manufacturing costs can be low. Furthermore, in this second embodiment, end portions outwardly of the seal portion of the seal pipe 144, which is interposed by the both O-rings 145 may be applied thereto with lip seals or the like, which are used in the ordinary seal construction, so that the frictional force of the plungers 51 and 56 can be reduced.

In working the present invention, if the interior of the cover 65 of the rotating cam mechanism 60 shown in FIG. 1 is sealed and lubricating oil is sealed in this interior, then the frictional force in the rotating cam mechanism 60 can be reduced, thus improving the durability.

Figure 13:
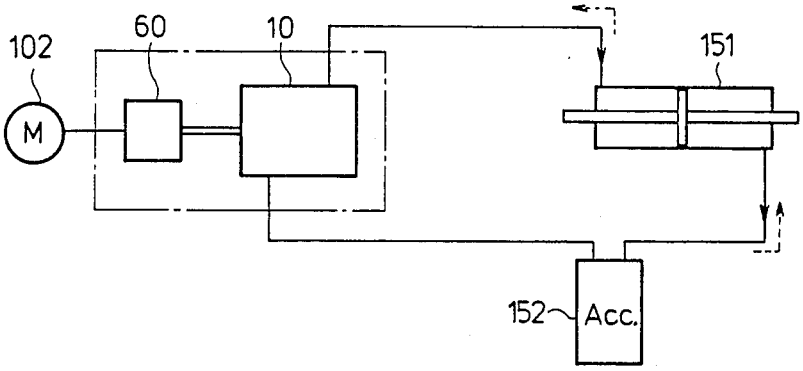
FIG. 13 is an explanatory view showing an utilized form of the device according to the present invention.
Figure 14:
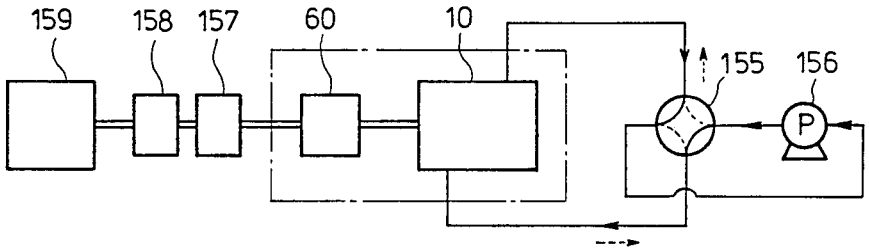
FIG. 14 is an explanatory view showing another utilized form of the device according to the present invention.

Further, working the present invention, in the respective embodiments, description has been given of the hydraulically participating mechanism 10 having the four unit pumps 95, however, theoretically, the number of the unit pumps 95 may be two or more. However, due to steepening the inclined angles of the cam surfaces 68A and 68B and so forth, linking of the discharging states between the unit pumps 95 may not necessarily be performed smoothly, so that the provision of about four of the unit pumps 95 may be practical. In the above embodiments, description has been given of examples in which the device according to the present invention is merely used as a discharge pump having an accurate discharge flow rate, however, as shown in FIG. 13, a bilaterally operable cylinder 151 as being a robot driving source is connected to the hydraulically participating mechanism 10 and an accumulator 152 for coping with the increase or decrease in volume of the working fluid due to changes in temperature is connected to the intermediate portion of this connecting circuit, so that the device can be utilized as a robot device capable of performing accurate driving. In this device shown in FIG. 13, movement of the cylinder 151 to the right or left can be accurately controlled by a very small value. Further, in the above embodiments, description has been given of the device, wherein the motor 102 as being the rotary driving source is used and the hydraulically participating mechanism 10 is driven by the motor 102, to thereby discharge the fluid accurately, however, as shown in FIG. 14, the hydraulically participating mechanism 10 may be used as a so-called hydraulic motor. More specifically, in FIG. 14, when a pump 156 is connected to the hydraulically participating mechanism 10 through a four way valve 155, this pump 156 is driven to reciprocate the first and second plungers 51 and 56 housed in the port block 20, this reciprocatory driving force is transmitted to the rotating cam mechanism 60 to rotatably drive the cam 68, and a driving force of this cam 68 is transmitted to a driven component 159 through a rotary angle detecting mechanism 157 such as a rotary encoder and a braking mechanism 158, the driven component 159 can be rotatably driven accurately. In short, it suffices that the device according to the present invention includes the hydraulically participating mechanism 10 having the pairs of plungers 51 and 56 housed in the port block 20, for performing the reciprocatory motion and the rotating cam mechanism 60 connected to these plungers 51 and 56, and the cam followers 69 and 70 abutted against the cam 68 of this rotating cam mechanism 60 are urged against the cam surfaces 68A and 68B by the wire 89. As the method of use of the device, a separate motor connected thereto may be used as a pump unit, or a separate pump connected thereto may be used a hydraulic motor.

As has been described hereinabove, the present invention can advantageously provide the continuously operable hydraulic device, wherein the angle of rotation of the rotating cam mechanism can be made accurately proportional to the flow rate of the fluid passing through the hydraulically participating mechanism.

What is claimed is:

1. A continuously operable hydraulic device, wherein a plurality of unit hydraulic devices are provided, each of said unit hydraulic devices comprises: a hollow port block; first and second ports communicated with the interior of said port block and provided at positions a predetermined distance apart from each other; first and second plungers inserted into said port block in a manner to be axially slidable on one and the same axial line and the end faces of which are opposed to each other; and and a rotating cam mechanism for driving the first and second plungers relative to said port block in a predetermined relationship with each other, said rotating cam mechanism having: an introducing function of moving the first and second plungers in directions for separating both plungers from each other by a predetermined value to introduce fluid of a predetermined value into a space formed between both plungers in a state where the space formed between the end faces of the first and second plungers, which are opposed to each other, is communicated with the first port; a valve switching means for moving the first and second plungers relative to said port block to positions where a portion of the fluid introduced in the space formed between the first and second plungers is communicated with the second port in such a manner that the first and second plungers are held in said positional relationship; and a discharging means for effecting a movement of the first and second plungers toward each other by a predetermined value after both plungers are moved toward the second port, to thereby discharge the fluid introduced into the space formed between the first and second plungers, and timing means for the timing of actions of said unit hydraulic devices such that the total quantity of the fluid caused to be discharged from the unit hydraulic devices by said rotating cam mechanism becomes constant at all times, said rotating cam mechanism being connected with a rotary angle detecting mechanism, a braking mechanism and a driven component, whereby fluid is supplied to the first port, so that said driven component is driven commensurate to the supplied value of the fluid.

2. A continuously operable hydraulic device as set forth in claim 1, wherein said rotating cam mechanism is connected thereto with a drivably controllable motor, such as a stepping motor or a servo motor, to thereby provide a continuously operable discharge pump being driven by said motor and capable of discharging fluid of a predetermined value.

3. A continuously operable hydraulic device, wherein a plurality of unit hydraulic devices are provided, each of said unit hydraulic devices comprises: a hollow port block; first and second ports communicated with the interior of said port block and provided at positions a predetermined distance apart from each other; first and second plungers inserted into said port block in a manner to be axially slidable on one and the same axial line and the end faces of which are opposed to each other; and a rotating cam mechanism for driving the first and second plungers relative to said port block in a predetermined relationship with each other, said rotating cam mechanism including: a cam having first and second cam surfaces; a first cam follower abutted against the first cam surface of said cam and connected to the first plunger; and a second cam follower abutted against the second cam surface of said cam and connected to the second plunger; and contours of the first and second cam surfaces of said cam being determined such that said rotating cam mechanism can perform: an introducing operation of moving the first and second plungers in directions for separating both plungers from each other by a predetermined value to introduce fluid of a predetermined value into a space formed between both plungers in a state where the space formed between the end faces of the first and second plungers, which are opposed to each other, is communicated with the first port; a valve switching means for moving the first and second plungers relative to said port block to positions where a portion of the fluid introduced in the space formed between the first and second plungers is communicated with the second port in such a manner that the first and second plungers are held in said positional relationship; and a discharging means for effecting a movement of the first and second plungers toward each other by a predetermined value after both plungers are moved toward the second port, to thereby discharge the fluid introduced into the space formed between the first and second plungers, timing means for the timing of actions of said unit hydraulic devices such that the total quantity of the fluid caused to be discharged from the unit hydraulic devices by said rotating cam mechanism becomes constant at all times, and a wire stretched in an endless manner so that said cam followers can be urged in directions of being abutted against the cam surfaces.

4. A continuously operable hydraulic device as set forth in claim 3, wherein the cam of said rotating mechanism is connected thereto with a drivably controllable motor such as a stepping motor or a servo motor, to thereby provide a continuously operable discharge pump driven by said motor and capable of discharging fluid of a predetermined value.

5. A continuously operable hydraulic device as set forth in claim 3, wherein said rotating cam mechanism is connected thereto with a rotary angle detecting mechanism, a braking mechanism and a driven component, whereby fluid is supplied to the first port, so that said driven component is driven as commensurate to the supplied value of the fluid.

* * * * *